US008303202B1

(12) United States Patent
Garcia

(10) Patent No.: US 8,303,202 B1
(45) Date of Patent: Nov. 6, 2012

(54) WRITING UTENSIL KIT AND METHOD OF USE

(76) Inventor: Rafael Garcia, Paterson, NJ (US)

( * ) Notice: Subject to any disclaimer, the term of this patent is extended or adjusted under 35 U.S.C. 154(b) by 1323 days.

(21) Appl. No.: 11/986,363

(22) Filed: Nov. 21, 2007

(51) Int. Cl.
*B43K 25/00* (2006.01)

(52) U.S. Cl. ..... 401/52; 434/85

(58) Field of Classification Search ..... 401/48, 401/52, 198, 199, 88; 434/409, 410, 81, 434/85, 98, 102
See application file for complete search history.

(56) References Cited

U.S. PATENT DOCUMENTS 2,453,201 A * 11/1948 Cushman ..... 401/207
3,684,389 A 8/1972 Eron et al.
3,969,028 A 7/1976 Negreiros
D257,857 S 1/1981 Leuenberger et al.
4,368,587 A * 1/1983 Childs ..... 40/615
4,723,859 A * 2/1988 Kitoh ..... 401/199
5,242,234 A 9/1993 Ahrens
5,388,924 A 2/1995 Chao
5,820,285 A * 10/1998 Ikeda et al. ..... 401/199
6,183,262 B1 * 2/2001 Tseng ..... 434/409
2003/0178493 A1 9/2003 Njolstad
2006/0222443 A1 * 10/2006 Savage et al. ..... 401/196
* cited by examiner

*Primary Examiner* — David Walczak
(74) *Attorney, Agent, or Firm* — Tanya L. Garrett; T. L. Garrett PLC

(57) ABSTRACT

A writing utensil kit comprising a plurality of writing utensils including an associated tip having at least one notch formed therein and adapted to mechanically engage a writing surface and produce a stylized design when manipulated thereupon by a user. A method of using the writing utensil wherein a user selects a writing utensil from the kit; orients the writing utensil such that the writing utensil is in mechanical engagement and fluid communication with a writing surface; and manipulates the writing utensil such that a stylized design is produced thereupon.

8 Claims, 7 Drawing Sheets

WRITING UTENSIL KIT AND METHOD OF USE

FIELD OF THE INVENTION

The present invention generally relates to writing utensils for use in the fields of art and graphic design.

BACKGROUND

The use of devices and methods relating to writing utensils are disclosed in U.S. Pat. No. 3,684,389 issued in the name of Eron et al., U.S. Pat. No. 5,388,924 issued in the name of Chao, U.S. Pat. No. D257,857 issued in the name of John P. Leuenberger et al, U.S. Pat. No. 3,969,028 issued in the name of Negreiros, U.S. Pat. No. 5,242,234 issued in the name of Ahrens, and U.S. Pat. No. 7,083,100 (previously U.S. Pub. No. 2003/0178493) issued in the name of Njølstad.

While existing devices suit their intended purposes, the need remains for a device and method of use that allow a user to rapidly create desired designs and styles of writing with a minimum of effort.

SUMMARY

A writing utensil kit is provided comprising a plurality of writing utensils including an associated tip having at least one notch formed therein and adapted to mechanically engage a writing surface and produce a stylized design when manipulated thereupon by a user.

A method of using the writing utensil is also provided wherein a user selects a writing utensil from the kit; orients the writing utensil such that the writing utensil is in mechanical engagement and fluid communication with a writing surface; and manipulates the writing utensil such that a stylized design is produced thereupon.

BRIEF DESCRIPTION OF THE DRAWINGS

These and other objects, features and advantages of the present invention will become apparent from the following detailed description and the appended drawings in which.

DETAILED DESCRIPTION OF THE INVENTION

Figure 1:
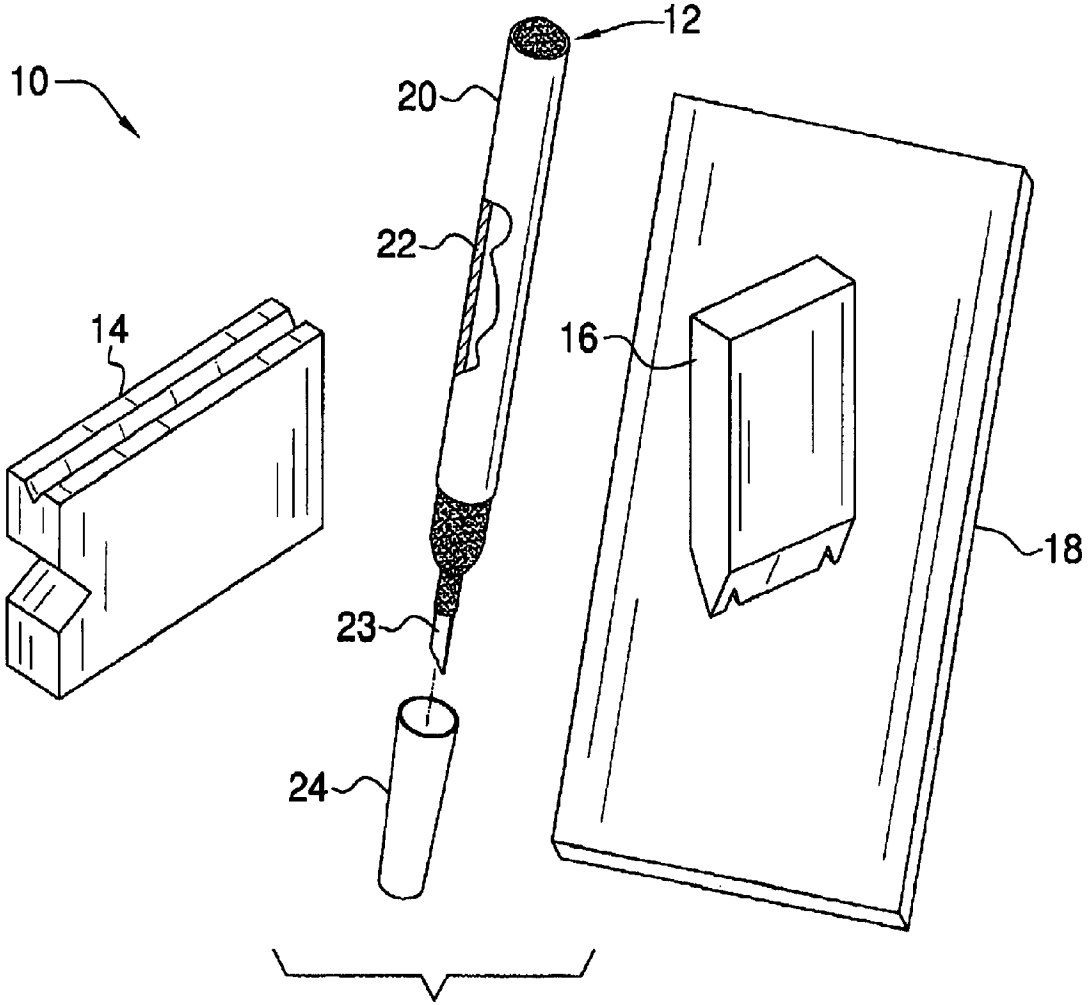
FIG. 1 illustrates a writing utensil kit in accordance with an embodiment of the invention.

In an embodiment of the invention, illustrated in FIG. 1, a writing utensil kit 10 is provided. The kit 10 includes a plurality of writing utensils including a plurality of markers 12; a plurality of chalks 14; a plurality of wipers 16; and a practice board 18. Throughout this description, and in the drawings, like elements shall be referred to with like numerals.

In one embodiment of the invention, each respective marker 12 of the plurality of markers 12 includes a different tip. Each of the respective tips are adapted to form a pattern of a different form when the tip is applied to a writing surface by a user.

In one embodiment of the invention, illustrated in FIG. 1, each of the respective markers 12 of the plurality of markers 12 includes a cylindrical, hollow body 20 adapted to receive an ink reservoir 22 therein and having a first end and a second end; a writing tip 23 disposed at the first end of the hollow body 20 and in fluid communication with the ink reservoir 22; and a top 24 adapted to removably and sealingly engage the first end of the hollow body 20 to cover both the first end of the hollow body 20 and the writing tip 23. A marker 12 of this type is disclosed in U.S. Pat. No. 3,113,336 issued in the name of Langnickel, which is hereby incorporated in its entirety herein by reference.

Figure 2:
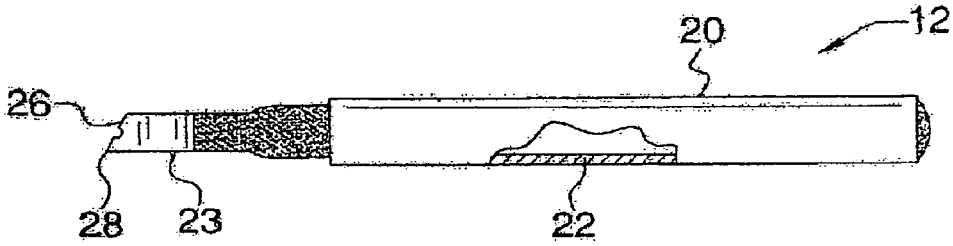
FIG. 2 illustrates a marker having a rounded tip in accordance with an embodiment of the invention.

In one embodiment of the invention, the kit 10 includes markers 12 having rounded tips 26, illustrated in FIG. 2. Each of the rounded tips 26 includes a writing tip 23 extending axially outward from the first end of the hollow body 20 of the marker 12 and having a first tip end (not shown) in fluid communication with an ink reservoir 22 disposed within the hollow body 20 of the marker 12 and a second tip end 28 adapted to engage a writing surface in fluid communication so as to deposit ink from the ink reservoir 22 upon the writing surface. Each of the rounded tips 26 includes a respective second tip end 28 having a generally elliptical form. The second tip end 28 of the rounded tip 26 may be perpendicular to the hollow body. In another embodiment of the invention, the second tip end 28 may be angled, as illustrated in FIG. 2, thereby forming a point at the second tip end 28.

Figure 13:
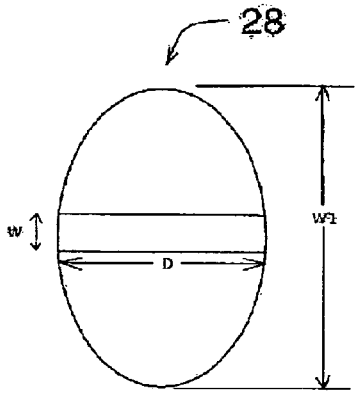
FIG. 13 illustrates a front plan view of an elliptical shaped tip end having a notch with a depth D and a width W in accordance with an embodiment of the invention.
Figure 3:
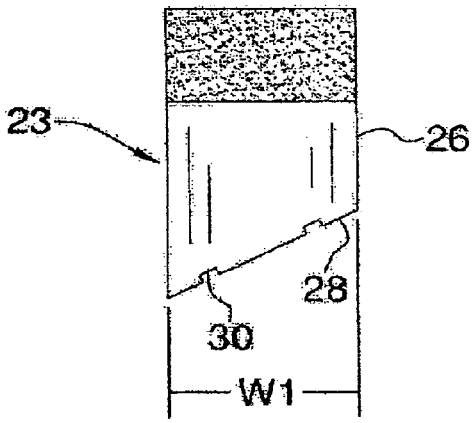
FIG. 3 illustrates a rounded tip including a plurality of notches in accordance with an embodiment of the invention.

In the embodiment of the invention shown in FIGS. 3 and 13 the major axis of the ellipse defining the shape of the writing tip defines the width W1 of the writing tip. The width of the rounded tip, W1 may include, but is not limited to dimensions ranging between and including one quarter (¼) inch to two (2) inches.

In the embodiment of the invention shown in FIGS. 3 and 13, each of the rounded tips 26 may include at least one notch 30 for producing a stylized design formed therein. Each of the notches 30 extends axially inward from the second tip end 28 and is formed at an angle perpendicular to the major axis of the ellipse and parallel with the minor axis of the ellipse and includes an associated depth D and an associated width W. The notch 30 may have a rectangular profile, such as the notch 30 illustrated in FIG. 3.

The notches 30 in the rounded tips 26 operate to form a desired design when a user engages the writing surface with the writing tip 23. The notch 30 produce the desired design by preventing ink from being fluidly communicated from the writing tip 23 to the writing surface in the region created by each notch 30, as the notch 30 creates a section of the writing tip 23 that is not in fluid communication with the writing surface over an area corresponding to the width W of the notch 30.

Figure 4:
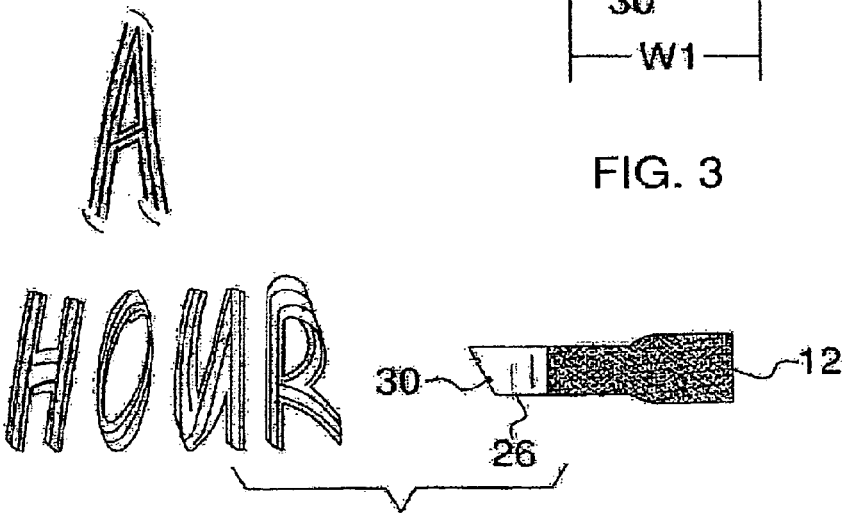
FIG. 4 illustrates stylized design formed by a rounded including a plurality of notches in accordance with an embodiment of the invention.

FIG. 4 illustrates writing formed by markers 12 having rounded tips 26 including at least one notch 30. As can be seen in FIG. 4, those areas of the rounded tip 26 having notch 30 do not communicate ink to the writing surface, thereby leaving those surfaces of the writing surface over which the notch 30 pass clear of ink.

Figure 5:
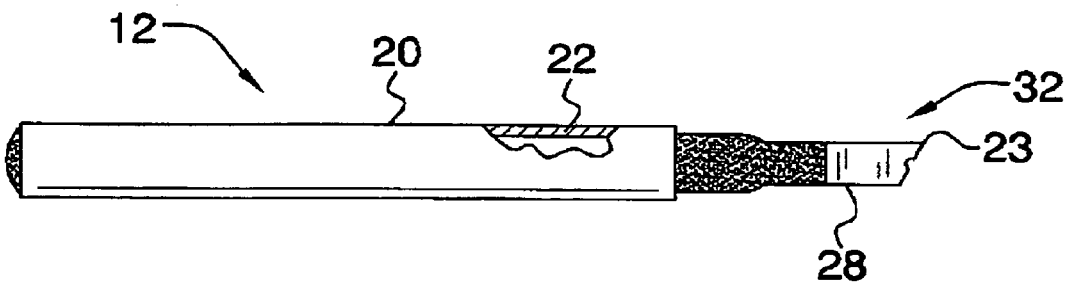
FIG. 5 illustrates a marker having a rectangular tip in accordance with an embodiment of the invention.
Figure 6:
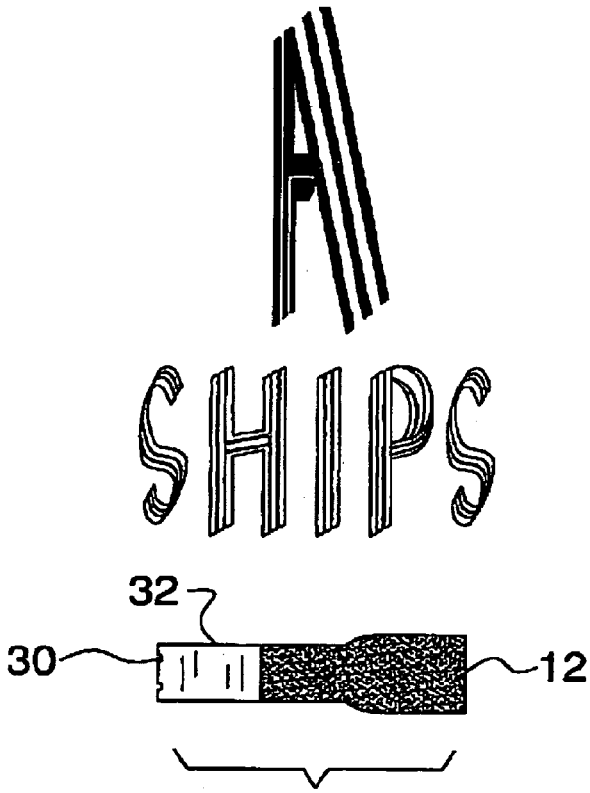
FIG. 6 illustrates a rectangular tip including a plurality of notches and a stylized design produced thereby in accordance with an embodiment of the invention.

In the embodiment of the invention illustrated in FIG. 5, the kit 10 includes markers 12 having rectangular tips 32. Each of the rectangular tips 32 includes a writing tip 23 extending axially outward from the first end of the hollow body 20 of the marker 12 and having a first tip end in fluid communication with an ink reservoir 22 disposed within the hollow body 20 of the marker 12 and a second tip end 28 adapted to engage a writing surface in fluid communication so as to deposit ink from the ink reservoir 22 upon the writing surface. Each of the rectangular tips 32 includes the second tip end 28 having a generally rectangular form. The second tip end 28 of the rectangular tips 32 may be perpendicular to the hollow body 20. In another embodiment of the invention, the second tip end 28 may be angled, as illustrated in FIGS. 5, 7, and 8, thereby forming a point at the second tip end 28.

Figure 7:
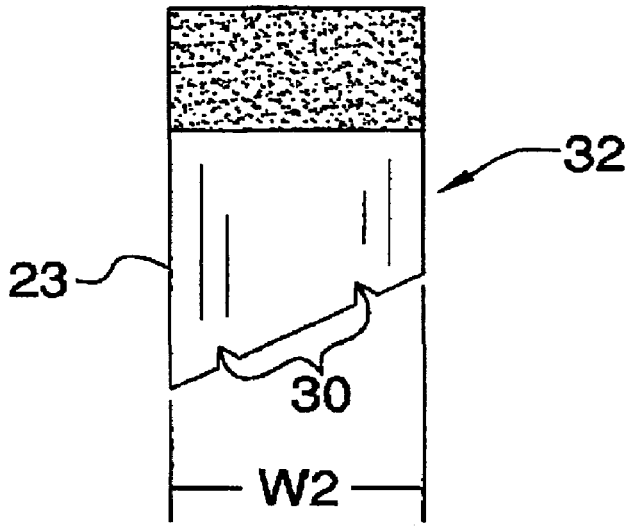
FIG. 7 illustrates a rectangular tip including a plurality of notches in accordance with an embodiment of the invention.
Figure 8:
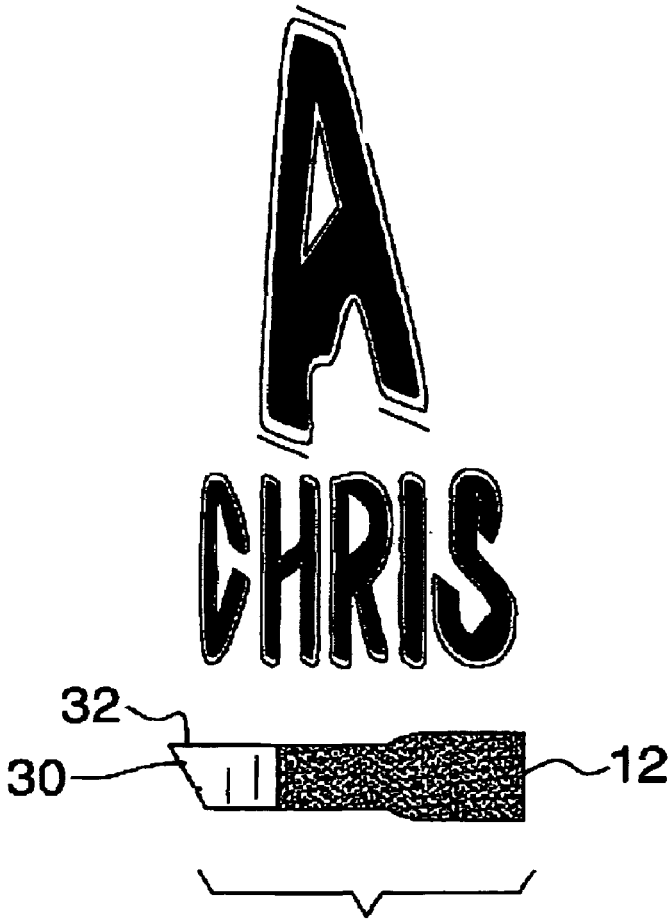
FIG. 8 illustrates a rectangular tip including a plurality of notches and a stylized design produced thereby in accordance with an embodiment of the invention.

In an embodiment of the invention, shown in FIG. 7, the major axis of the rectangle defining the shape of the writing tip 23 defines the width W2 of the writing tip 23. The width of the rectangular tip 32, W2 may range between and include one quarter (¼) inch to two (2) inches.

In another embodiment of the invention, each of the rectangular tips 32 may include at least one notch 30 for producing a stylized design formed therein. Each of the notch 30 extends axially inward from the second tip end 28 and is formed at an angle perpendicular to the major axis of the rectangle defining the shape of the writing tip 23 and parallel with the minor axis of the rectangle and includes a depth D and a width W. The notch 30 may have a triangular profile, such as the notches 30 illustrated in FIG. 7.

The notch 30 in the rectangular tips 32 operates to produce a stylized design when a user engages the writing surface with the writing tip 23. The notch 30 produce the stylized design by preventing ink from being fluidly communicated from the writing tip 23 to the writing surface in the region created by each notch 30, as the notch 30 creates a section of the writing tip 23 not in fluid communication with the writing surface over an area corresponding to the width W of the notch 30.

FIG. 8 illustrates a stylized design formed by markers 12 having rectangular tips 32 including at least one notch 30. As can be seen in FIG. 8, those areas of the rectangular tips 32 having notch 30 do not communicate ink to the writing surface, thereby leaving those surfaces of the writing surface over which the notch 30 pass clear of ink.

In another embodiment of the invention, shown in FIG. 7 including either rounded or rectangular tips 26,32, the at least one notch 30 may be formed at an angle that is not perpendicular to the major axis of the elliptical or rectangular form, but rather is formed an at angle that is acute to the major axis of the elliptical or rectangular form. The notch 30 formed at an acute angle to the major axis of the elliptical or rectangular form retain the same associated depth D and width W as those notch 30 formed parallel to the major axis of the elliptical or rectangular form.

FIG. 4 illustrates a stylized design formed by markers 12 having rounded tips 26 including at least one notch 30 formed at an angle that is not perpendicular to the major axis of the elliptical or rectangular form, but rather is formed an at angle that is acute to the major axis of the elliptical or rectangular form. As can be seen in FIG. 4, those areas of the writing tip 23 having notch 30 do not communicate ink to the writing surface, thereby leaving those surfaces of the writing surface over which the notches 30 pass clear of ink.

In an embodiment of the invention, each of the respective rounded and rectangular tips 26,32 may be formed of an absorbent material that is adapted to fluidly communicate ink from the ink reservoir 22 to the writing surface in a uniform and consistent manner. The material must also be durable, such that repeated use and use upon rough writing surfaces having abrasive textures do not degrade the uniformity of the marks produced thereby or the fluid-communicating ability of the material. Examples of the absorbent material may include, but are not limited to: felt, cotton, and synthetic fibers.

In an embodiment of the invention, the kit 10 includes a plurality of chalks 14 adapted to mechanically engage a writing surface and produce a stylized design when manipulated thereupon by a user. Each of the respective chalks 14 included in the kit 10 may be formed in the shape of a cube, illustrated in FIG. 9, the cube having six equal faces and eight vertices. The cube may be sized such that a user may easily grasp and manipulate the chalk 14. The kit 10 may include chalks 14 of differing sizes, as well as differing colors. The sizes of the cube shaped chalk 14 are dictated by the width of the faces of the cube, all of which are equal in a cubic form. The cube faces may have widths ranging between and including one-half of an inch to three inches.

Figure 10:
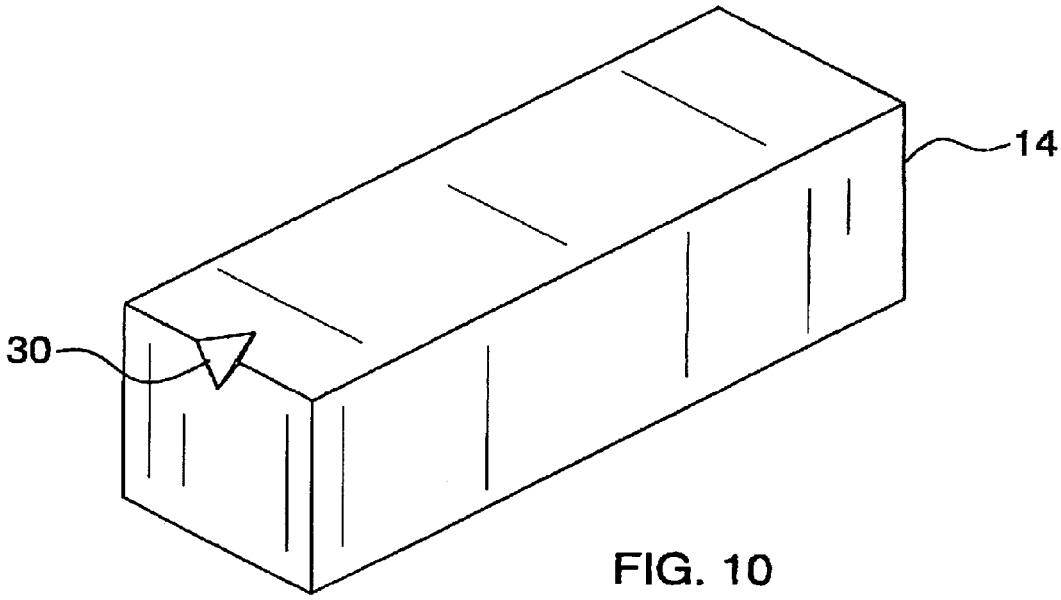
FIG. 10 illustrates a perspective view of a rectangular parallelepiped shaped chalk having a notch formed upon an edge thereof in accordance with an embodiment of the invention.

In another embodiment of the invention, illustrated in FIG. 10, the chalk 14 may be formed in the shape of a rectangular parallelepiped, the rectangular parallelepiped having three pairs of faces and eight vertices, with each pair of faces having an associated size. The kit 10 may include rectangular parallelepiped chalks 14 having differing colors and sizes. The rectangular parallelepiped shaped chalk 14 may be sized such that a user may easily grasp and manipulate the chalk 14.

The rectangular parallelepiped shaped chalk 14 may have differing aspect ratios defining the size of the rectangular parallelepiped. The aspect ratio may be defined as the ratio of the width of the rectangular parallelepiped when compared to the length of the rectangular parallelepiped. The aspect ratio may also be defined as the ratio of the height of the rectangular parallelepiped compared to the length of the rectangular parallelepiped.

In one embodiment of the invention, the rectangular parallelepiped shaped chalk 14 includes widths ranging between and including one-quarter (¼) of an inch to one (1) inch, heights ranging between and including one quarter (¼) of an inch to one (1) inch, and lengths ranging between and including one half (½) of an inch to four (4) inches.

Figure 9:
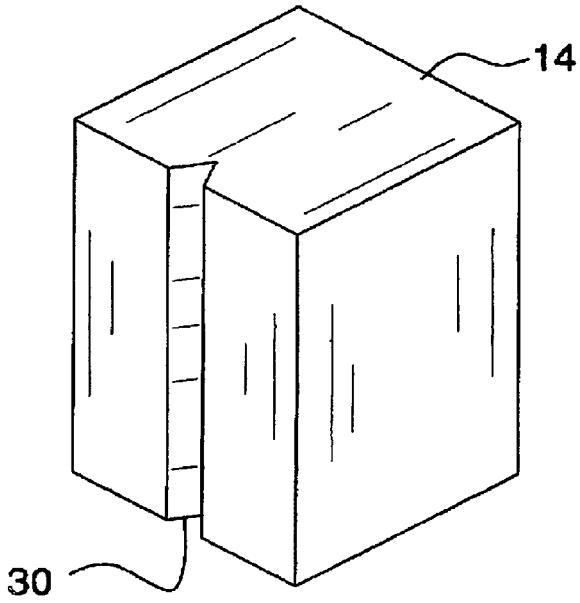
FIG. 9 illustrates a perspective view of a cube shaped chalk having a notch formed upon a face thereof in accordance with an embodiment of the invention.

In another embodiment of the invention, illustrated in FIGS. 9 and 10, each of the chalks 14 may include at least one notch 30 for producing a stylized design. The notch 30 may be formed in the chalks 14 in the same manner as the notch 30 formed in the writing tips 23 of the markers 12, as previously described herein. The notch 30 formed in the chalk 14 may be formed upon each of the six faces of the cube form or the rectangular parallelepiped, a single face of the cube form or the rectangular parallelepiped, or any combination of the faces of the cube form or the rectangular parallelepiped.

In another embodiment of the invention, illustrated in FIG. 10, the chalk 14 may have at least one notch 30 formed upon at least one edge formed by at least two vertices and at least two faces of either the cube shaped chalk 14 or the rectangular parallelepiped shaped chalk 14.

Figure 11:
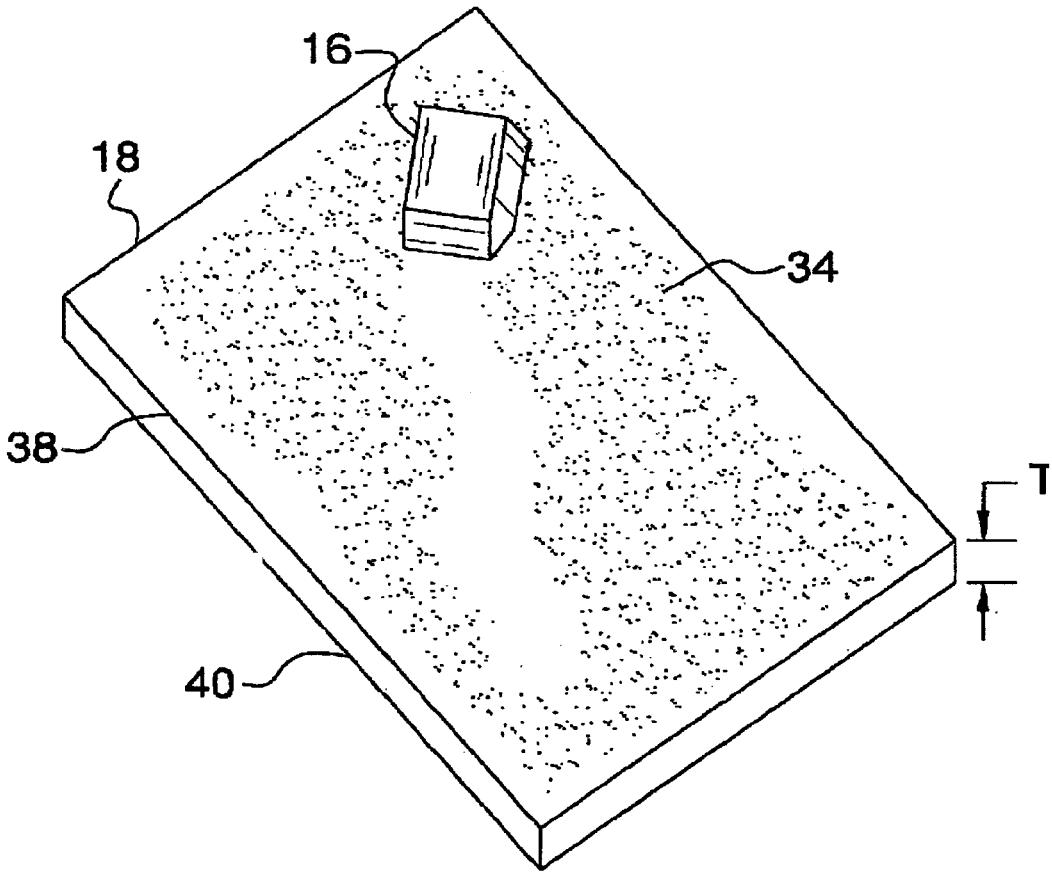
FIG. 11 illustrates a perspective view of a wiper and a practice board including a predefined quantity of a powdered media in accordance with an embodiment of the invention.

In one embodiment of the invention, the kit 10 includes a plurality of wipers 16, illustrated in FIGS. 1 and 11, adapted to mechanically engage a writing surface or practice board 18 and remove therefrom a powdered media 34. Each of the plurality of wipers 16 may include a different tip, each being adapted to produce a differing and distinct pattern thereby forming a stylized design when engaged with a writing surface or a practice board 18. Additionally, each of the plurality of wipers 16 may be formed having the same shapes and sizes of writing tips 23 as do the markers 12 and chalks 14 discussed previously herein, including notches 30 corresponding to those found in the previous description of the markers 12 and chalks 14.

In an embodiment of the invention, the wipers 16 do not contain ink and are not adapted for marking upon a writing surface. Rather, the wipers 16 are adapted to remove powdered media 34 from desired portions of a practice board 18, the practice board 18 to be described in greater detail below. The wipers 16, in conjunction with the practice board 18, allow a user to practice writing and graphic design in a non-permanent medium. Such practice is beneficial to a user, as the user may become proficient using utensils that precisely mimic the behavior and effects of the markers 12 and chalk 14 discussed previously herein. Such practice may reduce costs because ink, chalk, and writing surface expenditures are advantageously minimized during a user's learning process.

In another embodiment of the invention, the wipers 16 may also be used in conjunction with a typical writing surface, such as paper, rather than the practice board 18, to provide a user with a design that maybe traced using another writing utensil once a desired design has been created by a user.

In an embodiment of the invention, the wipers 16 may be formed of any durable material that is suitably rigid under loads imposed thereupon by a user. The material must also be non-reactive when exposed to a variety of powdered media 34 and not retain the powdered media 34 thereupon. Examples of suitable materials for the wipers 16 include, but are not limited to: synthetic foam, natural rubber, synthetic rubber, thermoplastics, thermosetting plastics and wood.

Figure 12:
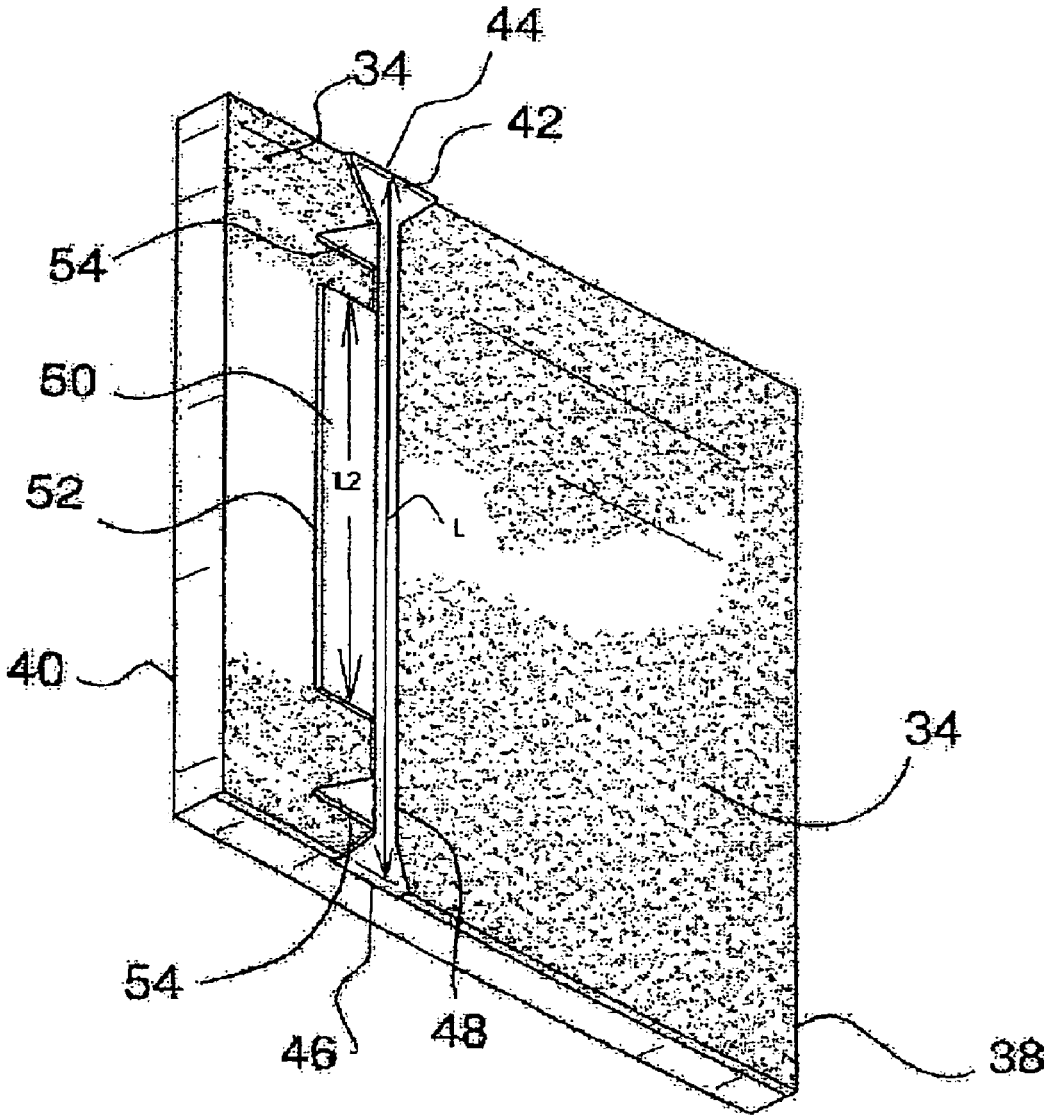
FIG. 12 illustrates a perspective view of a practice board including a predefined quantity of a powdered media and an erase-wiper having a wiper and a plurality of stalactiform points in accordance with an embodiment of the invention.

In one embodiment of the invention, illustrated in FIGS. 11 and 12, the kit 10 includes a practice board 18 for practice in forming stylized designs. The practice board 18 may be formed in the shape of a rectangular parallelepiped and include a first planar surface 38; a second planar surface 40; a thickness T defined by four edges that operate to join the first planar surface 38 with the second planar surface 40 thereby providing sufficient rigidity to prevent undesired flexure of the practice board 18; a predefined quantity of a powdered media 34 for forming stylized designs adapted to be applied to the first and second planar surfaces 38,40 of the practice board 18 and manipulated there upon by a user; and an erase-wiper 42, as illustrated in FIG. 12, slidingly affixed to at least two opposing edges of the rectangular parallelepiped forming the practice board 18 and adapted to mechanically and slidingly engage the first and second planar surfaces 38,40 of the practice board 18.

In an embodiment of the invention, the first and second planar surfaces 38,40 include a smooth and glossy finish, adapted to allow the powdered media 34 to be freely manipulated thereupon by a user without the powdered media 34 becoming entrapped within any surface porosity or imperfections.

In another embodiment of the invention including a practice board 18, the powdered media 34 may comprise a powder having a fine, granular structure and a non-toxic composition. Materials suitable for forming the powder may include, but are not limited to: baking powder, baby powder, baking soda, corn starch, powdered sugar, and talcum powder.

In another embodiment of the invention, illustrated in FIG. 12, including a practice board 18, the erase-wiper 42 may include an upper track 44 and a lower track 46 formed on opposing ends of the erase-wiper 42 in sliding engagement with opposing edges of the rectangular parallelepiped forming the practice board 18. The sliding engagement between the erase-wiper 42 and opposing edges of the practice board 18 operates to allow the erase-wiper 42 to slide in parallel with the edges of the practice board 18 to which the erase-wiper 42 is slidingly engaged, such that the erase-wiper 42 may slidingly travel from an edge of the practice board 18 to which the upper track 44 and lower track 46 are not affixed to an opposing edge of the practice board 18.

The erase-wiper 42 also includes an arm 48 in rigid mechanical engagement with the upper and lower tracks 44,46 for guiding motion of the erase-wiper 42. The arm 48 is an elongated member having a distal end affixed to the upper track 44; a proximal end affixed to the lower track 46; and an associated length L. A wiper 50 is slidingly affixed to the arm 48 such that the wiper 50 may slide along the length L of the arm 48, yet remain captured thereupon by the upper track 44 and the lower track 46.

The wiper 50 includes a predefined length L2 and a face 52 for mechanically engaging the first and second planar surfaces 38,40 of the practice board 18. The engagement of the face 52 with the first and second planar surfaces 38,40 of the practice board 18 operates to remove powdered media 34 from the portions of the first and second planar surfaces 38,40 of the practice board 18 that the face 52 engages, thereby removing stylized designs placed thereupon by a user.

In an embodiment of the invention, the wiper 50 is formed of a soft material that will not scratch or mar the first and second planar surfaces 38,40 of the practice board 18. Such materials may include, but are not limited to: felt, cotton, and natural or synthetic sponges.

In another embodiment of the invention, illustrated in FIG. 12, the erase-wiper 42 may include a plurality of stalactiform points 54 depending from the arm 48 in the direction of the practice board 18. The stalactiform points 54 are placed upon the arm 48 at a predefined distance from the upper track 44, the lower track 46, and each of the other stalactiform points 54. The stalactiform points 54 operate to remove powdered media from the practice board 18 in the same fashion as the wiper 50, but instead of clearing a broad swath across the practice board 18 as does the wiper 50, the stalactiform points 54 instead create a plurality of fine lines parallel with the motion of the erase-wiper 42. The fine lines operate as guides for a user using the practice board 18 to practice writing and who wishes to maintain uniformity in text height.

In an embodiment of the invention, each of the plurality of stalactiform points 54 are formed of a soft material that will not scratch or mar the first and second planar surfaces 38,40 of the practice board 18. Such materials may include, but are not limited to: felt, cotton, and natural or synthetic sponges.

A method of use is also provided. In an embodiment of the invention including markers 12, a user selects a marker 12 from the kit 10. The user then removes the top 24 from the marker 12 and orients the marker 12 such that the writing tip 23 is in mechanical engagement and fluid communication with a writing surface. The user then manipulates the marker 12 such that the ink flowing from the ink reservoir 22 to the writing surface produces a desired design or writing style.

In an embodiment of the invention including chalk 14, a method of use is provided wherein a user selects a chalk 14 having the desired shape and color. The user then manipulates the selected chalk 14 such that the chalk 14 is in mechanical engagement with a writing surface. Friction between the chalk 14 and the writing surface during manipulation by a user causes quantities of the chalk 14 to be deposited upon the writing surface, thereby creating a desired design or writing style.

In an embodiment of the invention including a practice board 18 and wipers 16, a method of use is provided wherein a user orients the practice board 18 such that the practice board 18 is in a desired position. The user then applies a predefined quantity of powdered media 34 to either a first planar surface 38 or second planar surface 40 of the practice board 18. The user applies the powdered media 34 such that there is an even dispersion of the quantity of powdered media 34 over the first or second planar surface 38,40 of the practice board 18.

The user then selects a wiper 16 having a shape and size desired by the user. The user then manipulates the wiper 16 such that the wiper 16 is placed in mechanical engagement with the first or second planar surface 38,40 of the practice board 18. The mechanical engagement of the wiper 16 with the first or second planar surface 38,40 of the practice board 18 causes the wiper 16 to remove a quantity of the powdered media 34 from those portions of the first or second planar surface 38,40 of the practice board 18, leaving a bare surface depicting a design or writing style thereupon visible because of the lack of powdered media 34.

In an embodiment of the invention including an erase-wiper 42, a user slides the erase-wiper 42 from one edge of the first or second planar surface 38,40 of the practice board 18 to an opposing edge of first or second planar surface of the practice board 18, thereby removing all of the powdered media 34 from an area corresponding to the width of the erase-wiper 42 and the distance between the opposing edges of the first or second planar surface 38,40 of the practice board 18.

In an embodiment of the invention including stalactiform points formed upon the erase-wiper 42, the erase-wiper 42 is moved in the same manner as noted as above. However, rather than wiping the powdered media 34 clear from the first or second planar surface of the practice board 18, the stalactiform points wipe only a narrow line of powdered media 34 from the first or second planar surface 38,40 of the practice board 18, leaving lines that allow a user to form lettering or a writing style having a uniform text height on the first or second planar surface 38,40 of the practice board 18.

In another embodiment of the invention, a user would apply a powdered media 34 to a writing surface, such as paper, and subsequently use one or more wipers 16 to form a desired design by removing powdered media 34 from desired areas of the writing surface. A user then uses another writing instrument to trace the outline of the powdered media 34 created by the wiper 16 onto the writing surface. The powdered media 34 may then be removed, leaving only the writing surface and the traced pattern.

While several aspects have been presented in the foregoing detailed description, it should be understood that a vast number of variations exist and these aspects are merely an example, and it is not intended to limit the scope, applicability or configuration of the invention in any way. Rather, the foregoing detailed description provides those of ordinary skill in the art with a convenient guide for implementing a desired aspect of the invention and various changes can be made in the function and arrangements of the aspects of the technology without departing from the spirit and scope of the appended claims.

What is claimed is:

1. A writing utensil kit comprising:

a plurality of writing utensils having at least one notch formed therein for forming stylized designs upon a writing surface, wherein the plurality of writing utensils includes at least one of a marker, a chalk, and a wiper; and a practice board for practice in forming stylized designs, formed in the shape of a rectangular parallelepiped and including a first planar surface adapted to receive a predefined quantity of a powdered media, a second planar surface adapted to receive a predefined quantity of a powdered media, a thickness T defined by four edges that operate to join the first planar surface with the second planar surface thereby providing sufficient rigidity to prevent undesired flexure of the practice board, a predefined quantity of a powdered media adapted to be applied to the first and second planar surfaces of the practice board and manipulated thereupon by a user for forming stylized designs, and an erase-wiper for removing a predefined quantity of powdered media from the practice board, slidingly affixed to at least two opposing edges of the rectangular parallelepiped forming the practice board and adapted to mechanically and slidingly engage the first and second planar surfaces of the practice board.

2. The writing utensil kit of claim 1, wherein the at least one wiper comprises:

a plurality of wipers for removing a predefined quantity of powdered media from a writing surface, thereby forming a stylized design thereupon and adapted to mechanically engage the writing surface.

3. The writing utensil kit of claim 1, wherein the erase-wiper further comprises:

an upper track and a lower track for guiding motion of the erase-wiper, each in sliding engagement with opposing edges of the rectangular parallelepiped forming the practice board whereby the sliding engagement between the erase-wiper and opposing edges of the practice board operates to allow the erase-wiper to slide in parallel with the edges of the practice board to which the erase-wiper is slidingly engaged, such that the erase-wiper may slidingly travel from an edge of the practice board to which the upper track and lower track are not affixed to an opposing edge of the practice board;

an arm in rigid mechanical engagement with the upper and lower tracks for supporting a wiper, including an elongated member having a distal end affixed to the upper track, a proximal end affixed to the lower track; and an associated length L; and a wiper affixed to the arm, and including a predefined length L2 and a face for mechanically engaging the first and second planar surfaces of the practice board whereby the engagement of the wiper surface with the first and second planar surfaces of the practice board operates to remove a predefined quantity of powdered media from the portions of the first and second planar surfaces of the practice board that the wiper surface engages, thereby removing stylized designs placed thereupon by a user.

4. The writing utensil kit of claim 3, wherein the erase-wiper further comprises:

a plurality of stalactiform points for removing powdered media from the practice board, thereby creating a plurality of fine lines parallel with the motion of the erase-wiper, and depending from the arm in the direction of the practice board, placed upon the arm at a predefined distance from the upper track, the lower track, and each of the other points.

5. The writing utensil kit of claim 1, wherein the powdered media further comprises:

a powder having a fine, granular structure and a non-toxic composition.

6. A method of using a writing utensil comprising:

providing a kit including a plurality of writing utensils having at least one notch formed therein for forming stylized designs upon a writing surface, wherein the plurality of writing utensils includes at least one of a marker, a chalk, and a plurality of wipers for removing a predefined quantity of powdered media from a writing surface, thereby forming a stylized design thereupon and adapted to mechanically engage the writing surface, and a practice board for practice in forming stylized designs, formed in the shape of a rectangular parallelepiped;

selecting a writing utensil from the kit;

orienting the writing utensil such that the writing utensil is in mechanical engagement and fluid communication with a writing surface;

manipulating the writing utensil such that a stylized design is produced thereupon;

orienting the practice board such that the ice board is in a desired position;

applying a predefined quantity of powered media to either a first planar surface or second planar surface of the practice board such that there is an even dispersion of the quantity of powdered media over the first or second planar surface of the practice board;

selecting a wiper from the plurality of wipers having a desired shape and size; and manipulating the wiper such that the wiper is placed in mechanical engagement with the first or second planar surface of the practice board, whereby the mechanical engagement of the wiper with the first or second planar surface of the practice board causes the wiser to remove a quantity of the powdered media from those portions of the first or second planar surface of the practice board, leaving a bare surface depicting a design or writing style thereupon visible because of the lack of powdered media.

7. The method of claim 6, further comprising:

selecting the chalk having a desired shape and color, manipulating the selected chalk such that the chalk is in mechanical engagement with a writing surface, thereby creating friction between the writing surface and the chalk; and depositing quantities of the chalk upon the writing surface through the friction created between the writing surface and the chalk, thereby creating a desired design or writing style.

8. The method of claim 6, further comprising:

sliding the wiper from one edge of the first or second planar surface of the practice board to an opposing edge of first or second planar surface of the practice board, thereby removing all of the powdered media from an area corresponding to the width of the wiper and the distance between the opposing edges of the first or second planar surface of the practice board.

* * * * *